US006302561B1

(12) United States Patent
Huang

(10) Patent No.: US 6,302,561 B1
(45) Date of Patent: Oct. 16, 2001

(54) LAMP KNITTING STRUCTURE ON NETTED LAMP MATRICES

(75) Inventor: Peter K. H. Huang, Taipei (TW)

(73) Assignee: Shinig Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/377,857

(22) Filed: Aug. 20, 1999

(51) Int. Cl.[7] ..... F21S 13/14
(52) U.S. Cl. ..... 362/252; 362/253
(58) Field of Search ..... 362/249, 252, 362/806, 807, 808, 121, 129, 812, 391; 40/550

(56) References Cited

U.S. PATENT DOCUMENTS 5,632,550 * 5/1997 Yeh ..... 362/123
5,800,046 * 9/1998 Lin ..... 362/252
5,944,408 * 8/1999 Tong ..... 362/252
5,951,146 * 9/1999 Lin ..... 362/252

* cited by examiner

*Primary Examiner*—Sandra O'Shea
*Assistant Examiner*—Hargobind S. Sawhney

(57) ABSTRACT

A lamp knitting structure on a netted lamp matrix having a plurality of lamp strings with conductors as net lines mutually intercrossed to form a network. Wherein, the lamp knitting structure includes a lamp matrix with a pattern or the shape of letters to be knitted onto the net lines. The conductors of the netted lamp matrix are fixed in positions with engaging members on the net lines. The knitted lamp matrix is provided with miniature lamps positioned at requisite locations for forming the pattern or letters to create more vivid, varied and stereoscopic visual decoration effect taking the netted-lamp matrix as a background.

3 Claims, 7 Drawing Sheets

LAMP KNITTING STRUCTURE ON NETTED LAMP MATRICES

BACKGROUND OF THE INVENTION

1. Field of the Invention

The present invention is related to a lamp knitting structure on netted lamp matrices, and especially to a lamp knitting structure to arrange a patterned lamp matrix onto another planar netted-lamp matrix which is used as a background. The whole decoration effect of such knitting is more varied.

2. Description of the Prior Art

A conventional lamp string mostly is made to have miniature lamps on lengthy conductors; this is monotonic in that it provides only linear lamp flashing. Lamp strings such as netted lamps existing now have a planar decoration effect; they have a lamp string and a conductor forming a planar lamp network. A whole plane of illumination or flashing effect can be obtained via the miniature lamps provided at intercrossing points on the network.

Such a netted lamp can further provide more varied illumination or flashing effect by providing multiple independent intercrossing lamp strings and conductors. The main power source of the netted lamp can be used to control turning on/off of the individual lamp strings through an electric control or an IC loop. Thereby, the netted lamp can form various patterns or literal lamp decoration on the plane of the network. For example, the way of controlling the turning on/off of the individual lamp strings can be: one of the lamp strings is lightened, while the other lamp strings are under control and not activated; alternatively, one of the lamp strings is tuned off, while the other lamp strings are turned on and lightened for illumination or flashing. Or in another mode, both or all the lamp strings are turned on and lightened for illumination or flashing individually. Such a netted lamp has really a better decoration effect as a whole than a conventional netted lamp. And such a netted lamp can form various patterns or literal lamp decoration on the plane of the network with the multiple lamp strings.

SUMMARY OF THE INVENTION

The object of the present invention is to further provide a patterned lamp matrix to be knitted onto the above-mentioned planar netted-lamp matrix, so that the whole decoration effect of the planar netted-lamp is more varied.

To achieve the object, the patterned lamp matrix knitted onto the planar netted-lamp matrix has its miniature lamps on lengthy conductors and being arranged to form desired letters or a pattern and connected by means of positioning members onto the net lines of the netted lamp matrix. An electric control loop and related elements are driven through a power source loop to synchronically control turning on/off and flashing of the individual lamp strings of the netted lamp and the knitted lamp matrix.

The patterned lamp matrix knitted onto the planar netted-lamp matrix can also be constructed with more than one lamp strings, in order that the letters or a pattern formed by the knitted lamp matrix can have vivid variation.

The present invention will be apparent in its novelty and other characteristics after reading the detailed description of the preferred embodiments thereof in reference to the accompanying drawings.

DETAILED DESCRIPTION OF THE PREFERRED EMBODIMENT

Figure 1:
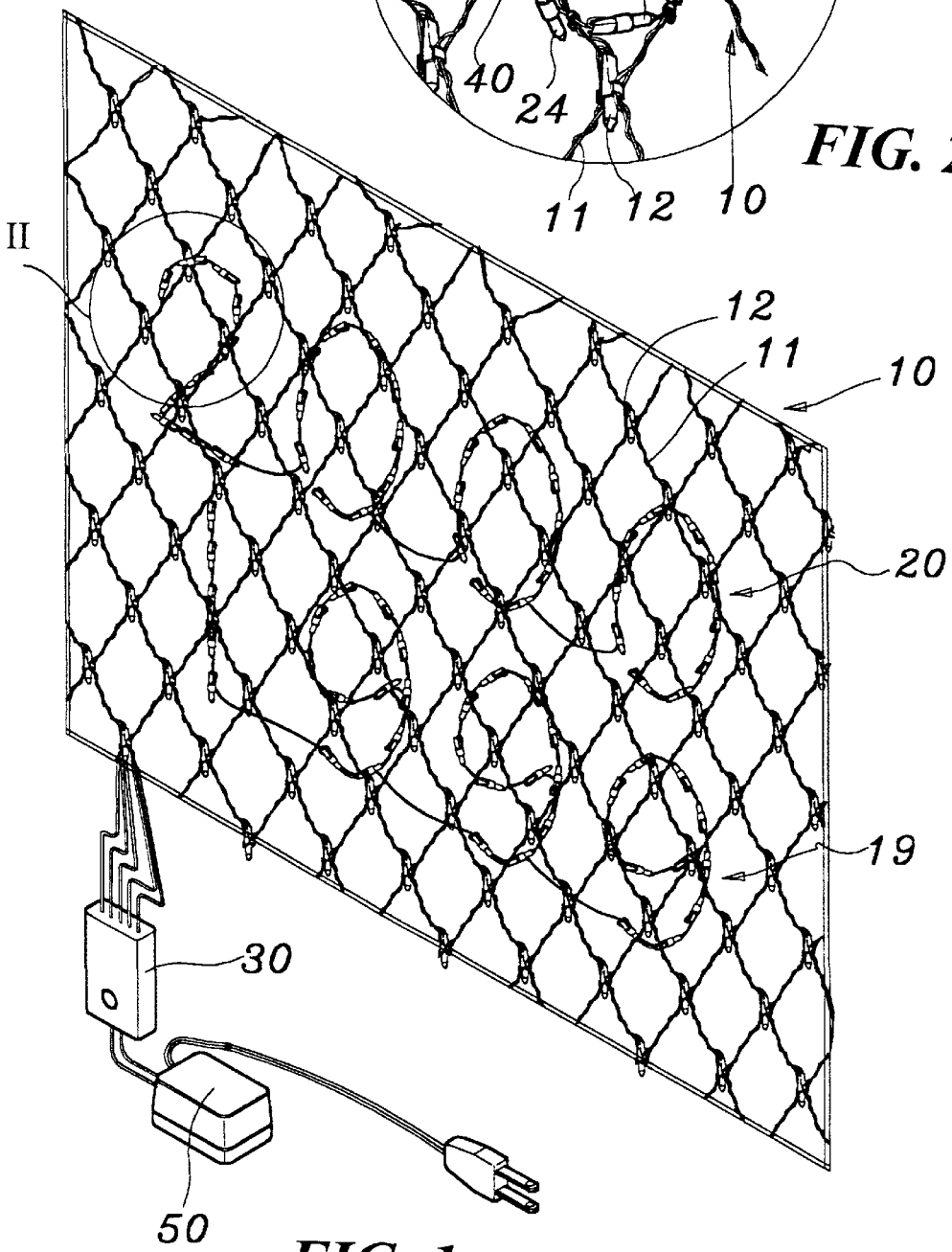
FIG. 1 is a perspective view of the first embodiment of the present invention.

Referring to FIG. 1, a netted lamp matrix 10 is depicted having a plurality of intercrossing conductors 11 forming a network. The whole netted-lamp matrix 10 is constructed with more than one lamp string. In the case wherein the lamp matrix 10 is constructed with two lamp strings, one of the lamp strings is used as background network, while the miniature lamps on the other of the lamp strings can be arranged at positions to form the desired pattern or letters. Hence the whole netted-lamp matrix 10 can provide an effect of turning on/off or flashing of a pattern or letters. The present invention takes this netted-lamp matrix 10 as a background thereof.

Figure 2:
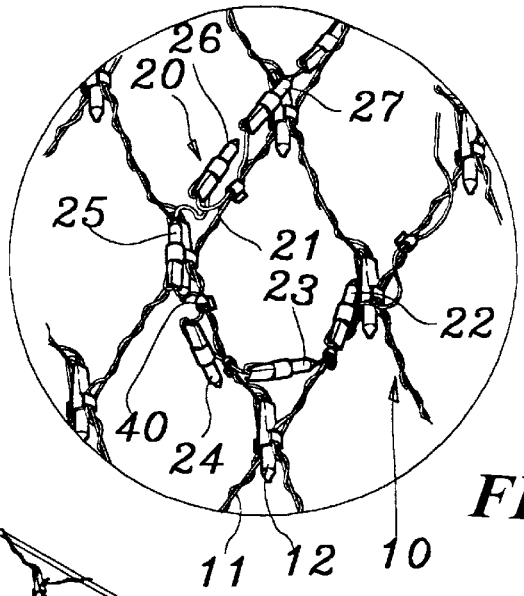
FIG. 2 is a partial enlarged view of area II in FIG. 1.
Figure 5:
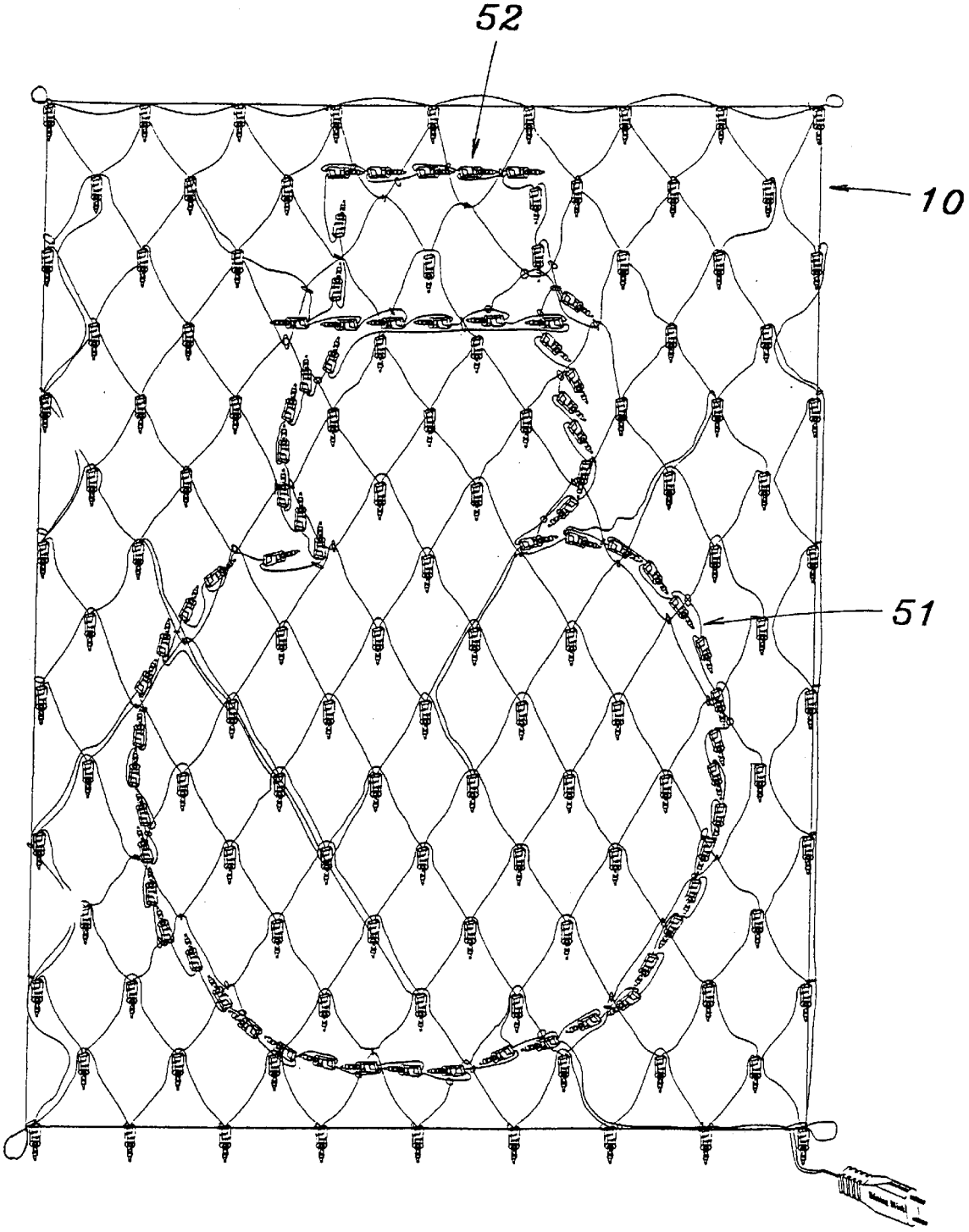
FIG. 5 is a front view of the second embodiment of the present invention.
Figure 6:
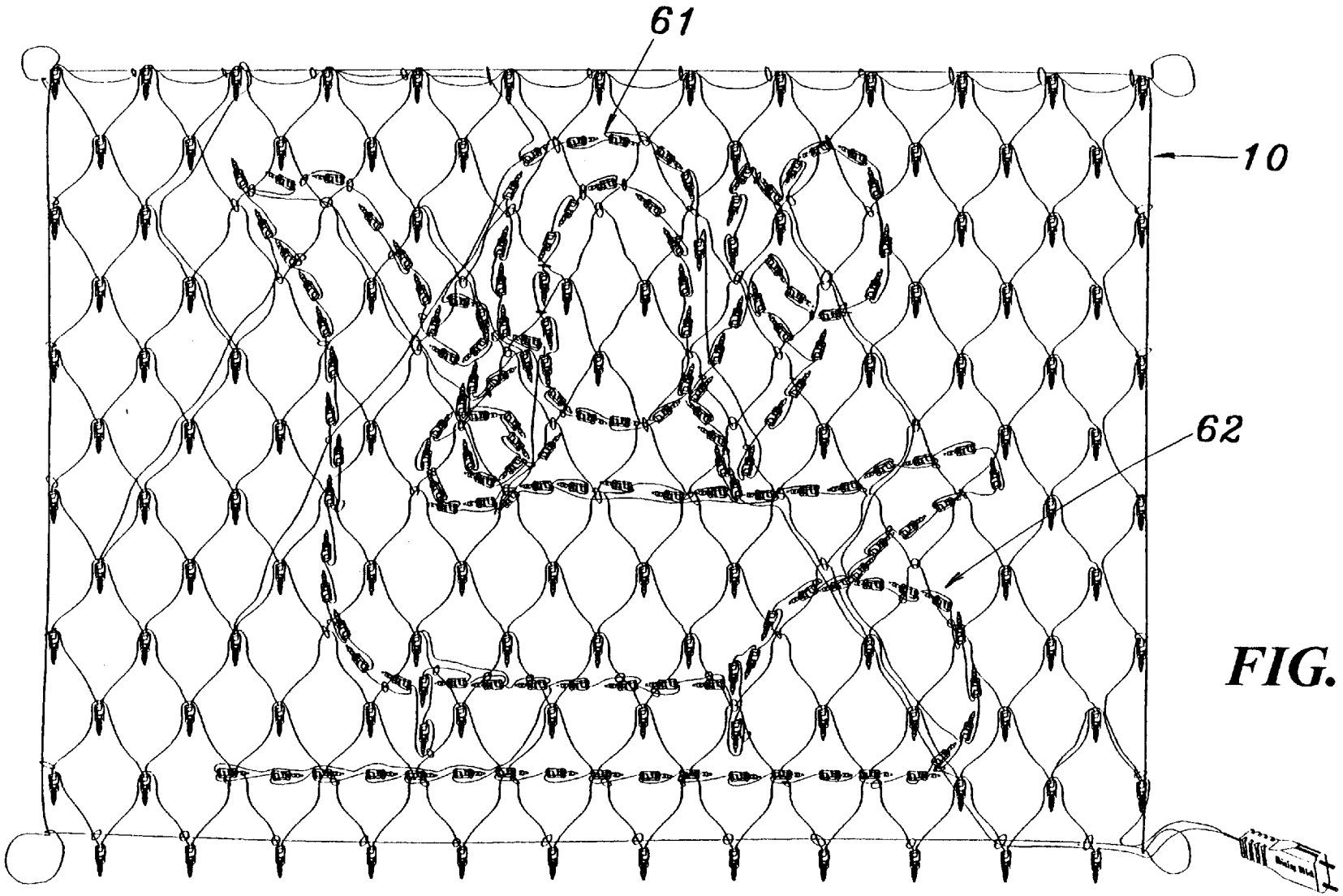
FIG. 6 is a front view of the third embodiment of the present invention.
Figure 7:
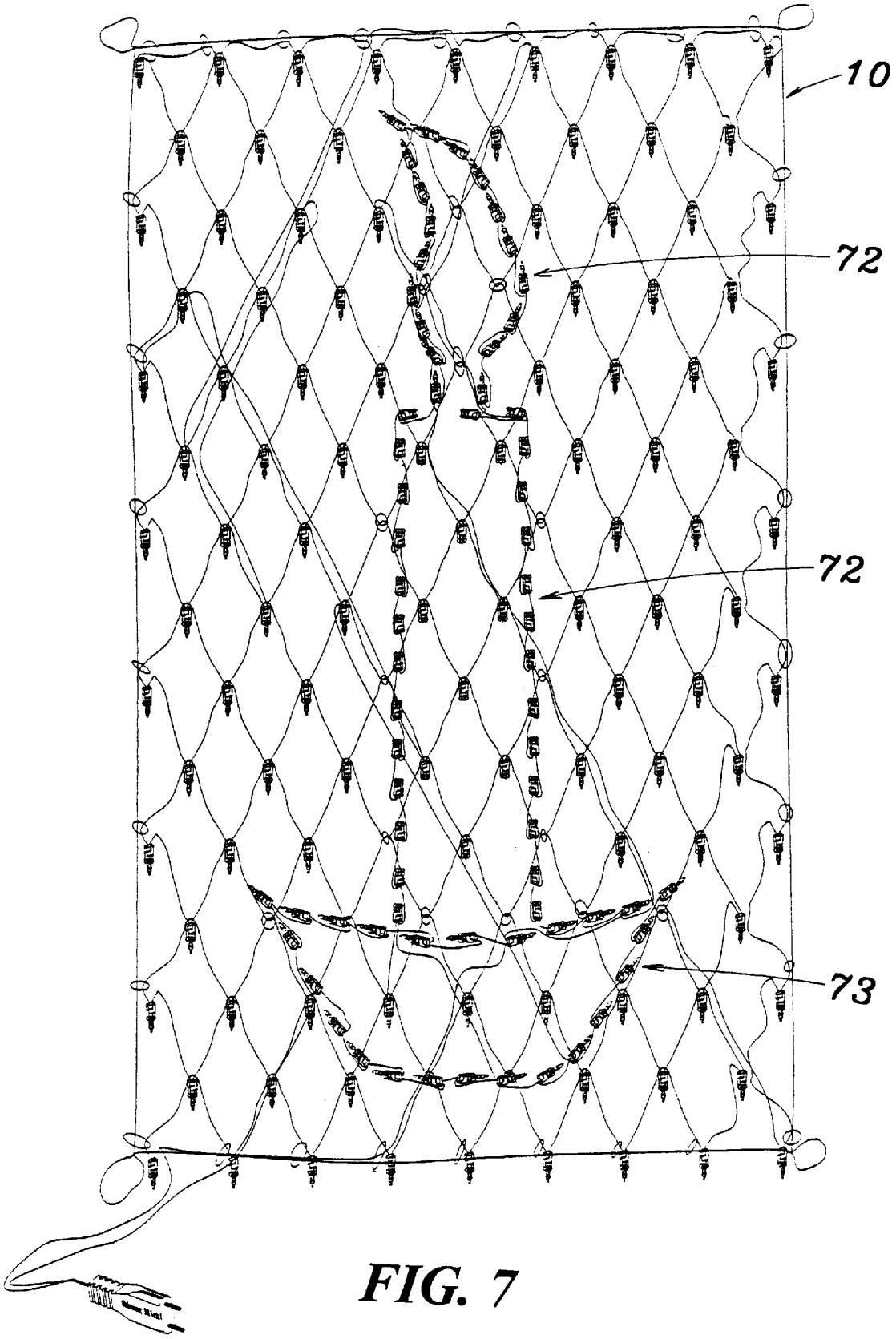
FIG. 7 is a front view of the fourth embodiment of the present invention.
Figure 8:
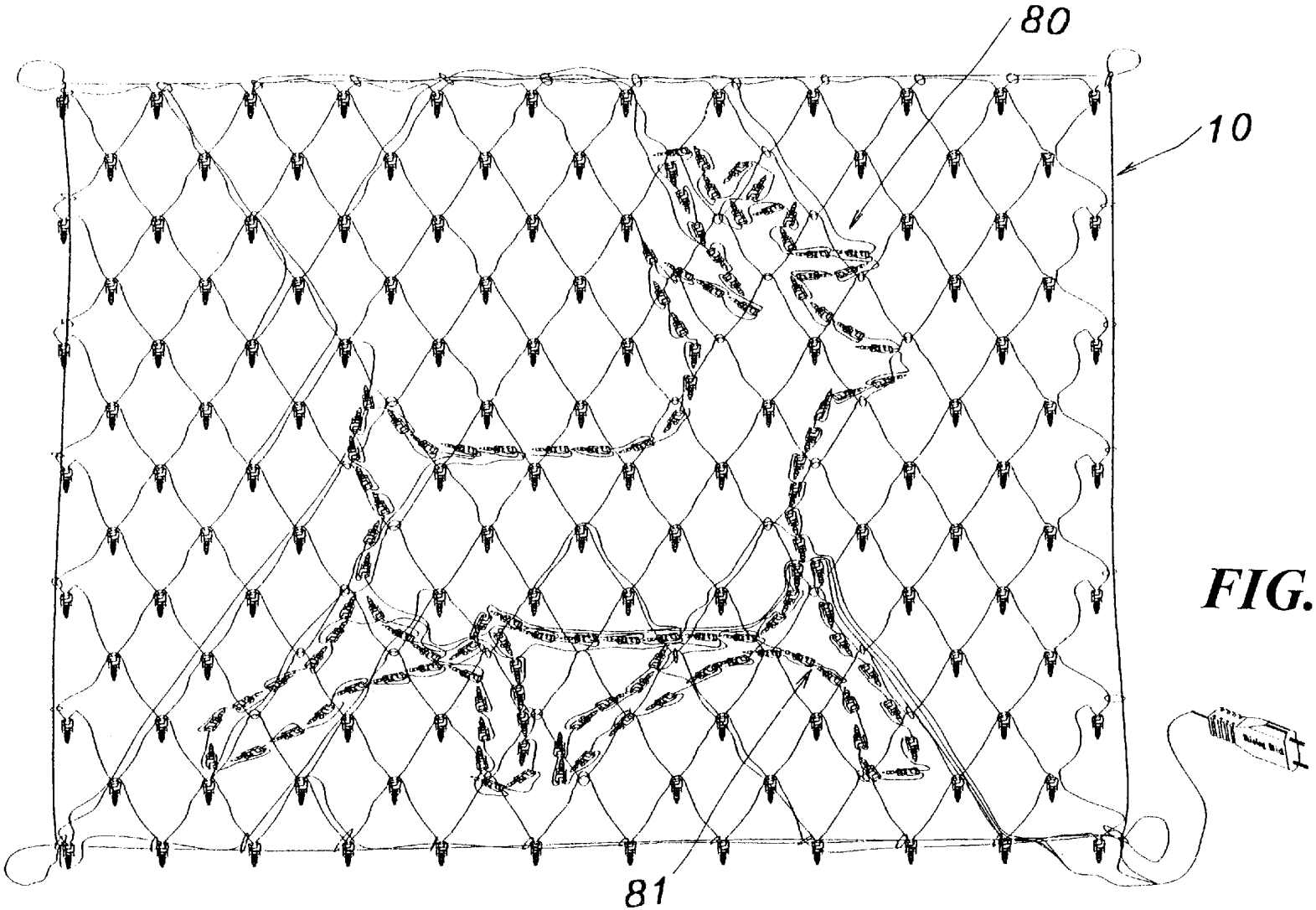
FIG. 8 is a front view of the fifth embodiment of the present invention.

Still referring now to FIG. 1, the present invention forms various knitted lamp matrices with letters (as shown in FIG. 1), figures (as shown in FIGS. 5, 6), decorative articles (as shown in FIG. 7), or animals (as shown in FIG. 8). In the case as shown in FIG. 1, the knitted lamp matrix with letters includes two lamp strings 19, 20. While in the case as shown in FIG. 2, one lamp string 20 of the two has its conductors 21 connecting the whole netted-lamp matrix 10 to function as the conductors 11 of the net lines and being fixed in positions with engaging members 40. The miniature lamps 22, 23 . . . , 27 on the lamp string 20 can be positioned at requisite locations for forming the letters. In the embodiment shown in FIG. 1, the two lamp strings 19, 20 have their miniature lamps positioned respectively to form two numbers "1999" and "2000".

Figure 3:
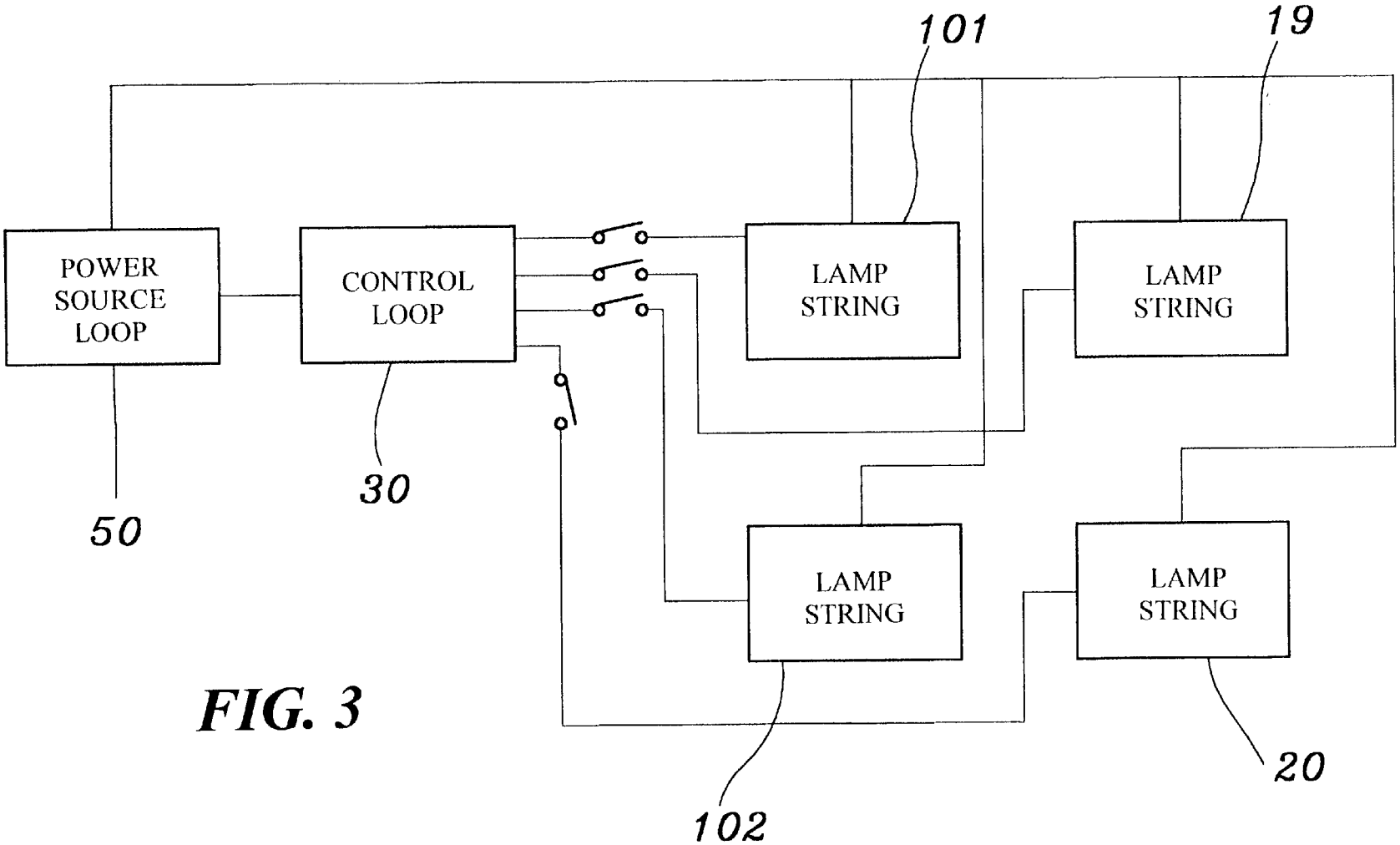
FIG. 3 is an electric block diagram for the embodiment of FIG. 1.

When the netted-lamp matrix 10 is constructed with two lamp strings as in the embodiment shown in FIG. 1, the electric circuit thereof shown in FIG. 3 can have two lamp strings 101, 102 and the two lamp strings 19, 20 of the knitted lamp matrix connected to a control loop 30 separately. Then turning on/off or flashing of the lamp strings 101, 102 and 19, 20 can be under control.

Figure 4:
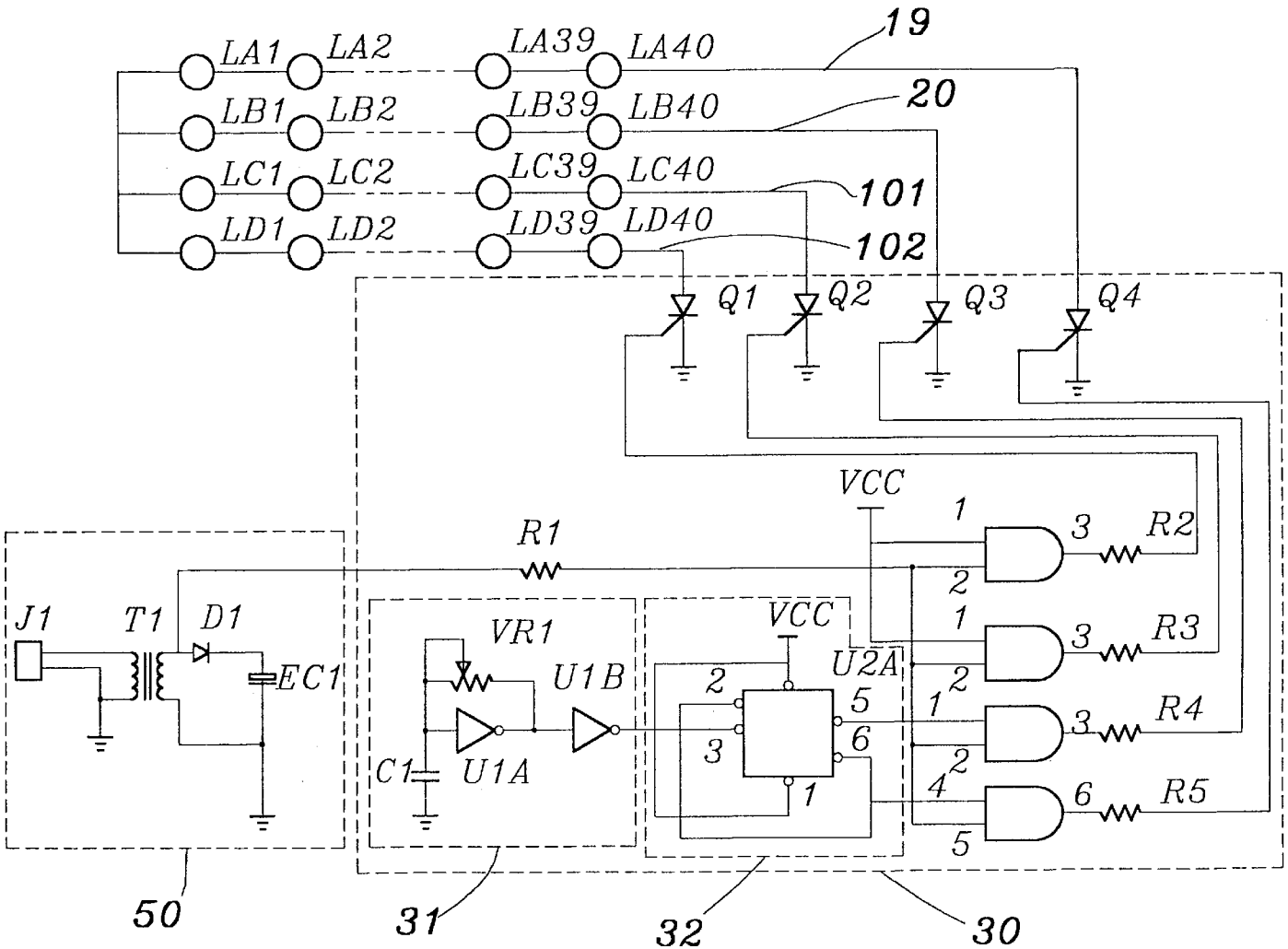
FIG. 4 shows an electric circuit suitable for the first embodiment depicted in FIG. 1.

Please refer to FIG. 4, the above mentioned control loop 30 includes generally an oscillator circuit 31 connecting with a "T" shaped flip-flop 32, and connecting with the lamp strings 101, 102 and 19, 20 via silicon controlled gating members. In this way, when a plug is inserted in, voltage of electric current is lowered through a transformer T1 in the power source loop 50 and sent to the control loop 30 and related circuits to control turning on/off or flashing of the lamp strings 101, 102 and 19, 20. In the drawings, LA1 . . . LA40 represent the miniature lamps of the first lamp string

19 of the knitted lamp matrix; LB1 . . . LB40 represent the miniature lamps of the second lamp string of the knitted lamp matrix. While LC1 . . . LC40 and LD1 . . . LD40 are respectively the first and the second lamp strings 101, 102 of the netted-lamp matrix 10.

With the above stated lamp structure, when in electrical connection of the electric circuit provided, the lamp strings 19, 20 knitted in the pattern formed from lamps can also be controlled to induce time difference for turning on/off or flashing in addition to turning on/off or flashing of the netted-lamp matrix 10 itself. Thereby, the decoration effect of the whole netted-lamp matrix 10 is more stereoscopic and varied.

When such a structure is applied on the knitted-in "snowman" pattern shown in FIG. 5, the FIG. 51 can be formed from the above mentioned first lamp string, the hat 52 can be formed from the above mentioned second lamp string. The FIG. 51 and the hat 52 can have different colors, plus variation of the netted-lamp matrix 10 as a background, the whole decorative lamp will be much more vivid. While when such a structure is applied on the knitted-in pattern shown in FIG. 6, wherein, the "Santa Claus" 61 and the "snow mobile" 62 can also be formed from two lamp strings. Similarly, in the knitted-in "candle stand" pattern shown in FIG. 7, the "candle light" 71, the "candle" 72 and the "stand" 73 can be formed from three lamp strings. And in the knitted-in pattern shown in FIG. 8, the pattern knitted-in is in the shape of a "deer" 80, The feet 81 thereof can be formed from a plurality of lamp strings. By control of time difference for turning on/off or flashing, a visual effect of running can be provided.

The present invention has a patterned lamp matrix knitted onto the netted-lamp matrix; the pattern of the knitted lamp matrix can create more vivid, interesting, stereoscopic and varied visual decoration effect taking the netted-lamp matrix as a background such as snowing scene or some other surrounding decorative articles. Such arrangement can make the original netted-lamp matrix more delightful for viewing.

Having thus described the structure of my invention with novelty and improvement, what I claim as new and desire to be secured by Letters Patent of the United States are:

1. A decorative knitted lamp assembly comprising:

a) a background netted lamp material comprising at least one first lamp string having a plurality of lamps arranged in a two-dimensional array having first and second oppositely facing sides and further having a plurality of intercrossing first conductors interconnecting the plurality of lamps;

b) at least one second lamp string having a plurality of lamps interconnected by second conductors;

c) a plurality of engaging members attaching the second conductors to the first conductors thereby attaching the at least one second lamp string to the first side of the background netted lamp matrix in a predetermined pattern; and d) a control device connected to the first and second lamp strings so as to independently control the operation of the first and second lamp strings, the control device including a control loop having an oscillator circuit connected with a "T" shaped flip-flop and silicon controlled gating members connected to the first and second lamp strings, and a power source loop connected to the control loop, the power source loop including a transformer.

2. The decorative knitted loop assembly of claim 1 wherein the background netted lamp matrix comprises a plurality of first lamp strings.

3. The decorative knitted lamp assembly of claim 1 further comprising a plurality of second lamp strings each attached to the first side of the background netted lamp matrix by the engaging members.

* * * * *